US007029079B2

(12) United States Patent
Holt

(10) Patent No.: US 7,029,079 B2
(45) Date of Patent: Apr. 18, 2006

(54) RECESS-COMPUTER FURNITURE UNIT FOR DISCRETELY CONCEALING ELECTRONICS AND FLAT PANEL SCREEN

(76) Inventor: Aaron Holt, 1553 North Bedford Dr., Camarillo, CA (US) 93010

( * ) Notice: Subject to any disclaimer, the term of this patent is extended or adjusted under 35 U.S.C. 154(b) by 0 days.

(21) Appl. No.: 10/444,448

(22) Filed: May 22, 2003

(65) Prior Publication Data

US 2004/0007949 A1 Jan. 15, 2004

Related U.S. Application Data

(63) Continuation-in-part of application No. 29/163,651, filed on Jul. 10, 2002, now Pat. No. Des. 474,920.

(51) Int. Cl.
*A47B 81/00* (2006.01)

(52) U.S. Cl. ..... 312/223.3; 312/208.1; 108/50.01

(58) Field of Classification Search ..... 312/223.3, 312/194, 195, 208.1, 283; 108/50.01, 50.02
See application file for complete search history.

(56) References Cited

U.S. PATENT DOCUMENTS

| | | | |
|---|---|---|---|
| 427,217 | A | 5/1890 | Bancroft |
| 1,181,739 | A | 5/1916 | Clark |
| 2,155,293 | A | 4/1939 | Bargen |
| D119,462 | S | 3/1940 | Rudman et al. |
| 2,316,756 | A | 4/1943 | Balster |
| 3,321,257 | A | 5/1967 | Carlson |
| 4,145,097 | A | 3/1979 | Naess et al. |
| D253,862 | S | 1/1980 | Adkinson |
| D262,205 | S | 12/1981 | Soda |
| 4,669,789 | A | 6/1987 | Pemberton |
| 4,695,104 | A | 9/1987 | Lederman |
| 4,735,467 | A | 4/1988 | Wolters |
| 4,828,342 | A | 5/1989 | Stefan |
| 4,861,121 | A | 8/1989 | Gotz |
| 5,033,804 | A | 7/1991 | Faris |
| 5,071,204 | A | 12/1991 | Price et al. |
| 5,094,514 | A | 3/1992 | Grosch |
| 5,101,736 | A | 4/1992 | Bommarito et al. |
| 5,118,172 | A | 6/1992 | Ugalde |
| D335,225 | S | 5/1993 | Ugalde |
| 5,242,217 | A | 9/1993 | Gonnet |
| 5,265,952 | A | 11/1993 | Greshem et al. |
| 5,364,177 | A | 11/1994 | Ugalde |
| 5,452,950 | A | 9/1995 | Crenshaw et al. |
| 5,480,224 | A | 1/1996 | Ugalde |
| D367,471 | S | 2/1996 | Brown |

(Continued)

*Primary Examiner*—Anthony D. Barfield
(74) *Attorney, Agent, or Firm*—Robert D. Chabot

(57) ABSTRACT

Disclosed is a recess-computer furniture unit that serves or both a conventional piece of furniture in one configuration, and as a computer station in a second configuration. The furniture unit includes a plurality of panels conformally integrated into the unit. These panels open to reveal a computer housing, keyboard, and flat panel monitor. In this operational configuration, a front access panel provides a support surface for the keyboard, and an upper access panel provides a mounting support for the monitor. The computer housing is discretely concealed below in a cavity created between the upper access panel and the underside of the furniture.

6 Claims, 8 Drawing Sheets

U.S. PATENT DOCUMENTS

| | | | | |
|---|---|---|---|---|
| 5,489,938 | A | | 2/1996 | Maruyama et al. |
| D381,529 | S | | 7/1997 | Ugalde |
| 5,746,489 | A | | 5/1998 | Moon |
| 5,797,666 | A | | 8/1998 | Park |
| 5,896,817 | A | | 4/1999 | Hancock |
| 5,951,128 | A | * | 9/1999 | Aidone et al. ..... 312/223.3 X |
| 5,957,059 | A | | 9/1999 | Burhman |
| D416,712 | S | | 11/1999 | Chou |
| 6,022,087 | A | * | 2/2000 | Gilbert ..... 312/194 X |
| 6,059,385 | A | | 5/2000 | Guhl |
| 6,170,406 | B1 | | 1/2001 | Klein et al. |
| 6,186,076 | B1 | | 2/2001 | Sung |
| 6,286,440 | B1 | | 9/2001 | Jyringi |
| 6,446,564 | B1 | | 9/2002 | Anderson |
| 6,493,220 | B1 | * | 12/2002 | Clark et al. ..... 312/223.3 X |
| 6,508,526 | B1 | | 1/2003 | Reppas et al. |
| D474,920 | S | | 5/2003 | Holt |
| 2002/0097567 | A1 | | 7/2002 | Zodnik et al. |

* cited by examiner

RECESS-COMPUTER FURNITURE UNIT FOR DISCRETELY CONCEALING ELECTRONICS AND FLAT PANEL SCREEN

CROSS-REFERENCE TO RELATED APPLICATIONS

This application is a continuation-in-part of U.S. Design patent application Ser. No. 29/163,651, filed Jul. 10, 2002, now U.S. Design Pat. No. 474,920, the application of which is hereby incorporated herein by reference in its entirety.

FIELD OF INVENTION

The invention generally relates to the field of furniture used with electronic devices that employ a visual display. In particular, the invention relates to an arrangement of elements embodied in an article of furniture that discretely conceals a computer in a first configuration while allowing a person to operate the computer in a second configuration.

BACKGROUND

The related art is rife with computer desks and other furniture able to hold a computer case, keyboard, and monitor. The vast majority of these references are, however, particularly undesirable for high end environments and discerning customer because the computer remains visible even when the computer is not in use, thereby destroying the aesthetic appeal of the furniture.

In some disclosures, there are attempts to conceal the computer inside the furniture when not being used. The furniture is then reconfigured to reveal the computer when need. While these references work towards the same goal as the present invention, the prior attempts are generally directed to computers comprising cathode ray tubes (CRTs). Because of the size and weight of CRTs, these prior art computer desks rely on large CRT cabinets that are suspended below the desk top in both the concealed and operating configurations. The user must therefore view the CRT by peering down into the desk, which is not only awkward, but obstructs the visual access to CRT to all but the individual seated before the desk.

In another prior art attempt, U.S. Pat. No. 6,508,526 to Reppas el al. discloses a "convertible bed with computer desk." In this desk, a flat panel display is mounted to the underside of a bed frame. The usefulness of this configuration is, however, severely limited due to the fact that the entire bed frame rotates upward to reveal the monitor. The distance between the monitor and the user in the operating configuration is at least the width of the bed frame. Even a small bed, e.g. a twin bed, puts the monitor over 40 inches away from the user. For all but the most visually gifted, the display resolution of the monitor will necessarily be significantly reduced in order to make the screen legible from that distance.

There is therefore a need for an article of furniture able to protectively conceal a computer in a closed configuration while making the monitor highly accessible and viewable in the operating configuration, without impacting the overall appearance and utility of the article of furniture for other purposes.

SUMMARY

The invention presented in the several embodiments herein provides for various articles of furniture that can be configured to both discretely conceal a computer or to make the computer readily accessible and viewable to the user. The particular embodiments disclosed retain the functionality of prior computer desks while enhancing the aesthetic and utilitarian appeal of the unit as articles of furniture. Moreover, the recess-computer furniture unit of the present invention may be integrated into any number of furniture types, including but not limited to, desks, computer tables, occasion tables, coffee tables, armoires, vanity table, and counters including residential, commercial, and restaurant counters.

The invention according to the first preferred embodiment is a recess-computer furniture unit for housing a general-purpose computer including a computer housing, flat panel monitor, and computer keyboard. The recess-computer furniture unit comprises a top side, a front side, and a lower surface. The top side includes an upper panel, and an upper access panel adapted to securably support the flat panel monitor. In the preferred embodiment, the upper access panel rotates relative to the upper panel between a closed position substantially flush with the upper panel, and a substantially vertical position in which the flat panel monitor mounted thereon is visible to a user.

The front side includes a front panel, and a front access panel unit adapted to securably support the computer keyboard. In the preferred embodiment, the front access panel rotates between a closed position substantially flush with the front panel, and a substantially horizontal position in which the keyboard is ergonomically accessible to the user.

The lower surface of the recess-computer furniture unit is displaced from the top side so as to form a cavity or compartment adapted to receive the computer housing. Together, computer housing, flat panel monitor, and computer keyboard are protectively concealed within the recess-computer furniture unit when the upper access panel and front access panel are seated in the closed position.

In some alternative embodiments, the recess-computer furniture unit is adapted to retain the computer housing underneath the upper panel and adjacent to the computer users legs, for example. The recess-computer furniture unit may include a cabinet, for example, to either the left or right side of the unit that is adapted to receive the computer housing. The cabinet for the computer housing is preferably adapted to receive a tower-type housing oriented vertically, although a desk top unit oriented vertically or horizontally may also be implemented in alternative embodiments.

The invention according to the second preferred embodiment is a recess-computer furniture unit comprising a top side, a lower surface, and side partitions. The top side includes an upper panel, and an upper access panel adapted to securably support the flat panel monitor. The upper access panel preferably rotates relative to the upper panel between a closed position substantially flush with the upper panel, and a substantially vertical position in which the flat panel monitor mounted thereon is visible to a user. The lower surface is displaced from the top side so as to form a cavity adapted to receive the computer housing. The side partitions, which may include one or more speakers, are affixed to the upper panel and lower surface on either side of the cavity adapted to receive the computer housing. When the upper access panel and front access panel are seated in the closed position, the computer housing, flat panel monitor, and computer keyboard are protectively concealed within the recess-computer furniture unit.

The invention according to the third preferred embodiment is a modular recess-computer furniture unit comprising an enclosure, an upper access panel, and a front access panel. The enclosure includes an upper member, a lower member, and side members. The enclosure is preferably adapted to retain the computer housing, the flat panel monitor, and the computer keyboard therein. The upper access panel is adapted to rigidly support the flat panel monitor in the closed and operable configurations. In particular, the upper access panel rotates relative to the upper member between a closed position substantially flush with the upper member, and a substantially vertical position in which the flat panel monitor mounted thereon is visible to a user. The front access panel is adapted to support the keyboard in the operable configuration. Preferably, the front access panel rotates between a closed position substantially perpendicular to the upper access panel, and a substantially horizontal position in which the keyboard is preferably ergonomically accessible to the user. According to this embodiment, the computer housing, the flat panel monitor, and the computer keyboard are protectively concealed within the recess-computer furniture unit when the upper access panel and front access panel are seated in the closed position.

In some of these embodiments, the recess-computer furniture unit further includes side partitions, including a left-side partition and a right-side partition, defining the sides of the cavity that receives the computer housing. Speakers may be mounted in the side partitions and or in the lower surface, or distributed in both the side partitions and the lower surface.

The recess-computer furniture unit may, in alternative embodiments, further include a maintenance panel, whereby a user may access the computer housing protectively concealed in the cavity from either the front or other side if the recess-computer furniture unit. The maintenance panel is preferably at the rear side of the recess-computer furniture unit opposite the front side.

The recess-computer furniture unit may even include a protective liner or a shuttle slidably attached to the unit for moving the computer housing between a first position in proximity to the front access panel and a second position in proximity to the maintenance panel without scaring the inside of the recess-computer furniture unit.

DETAILED DESCRIPTION

Figure 1A:
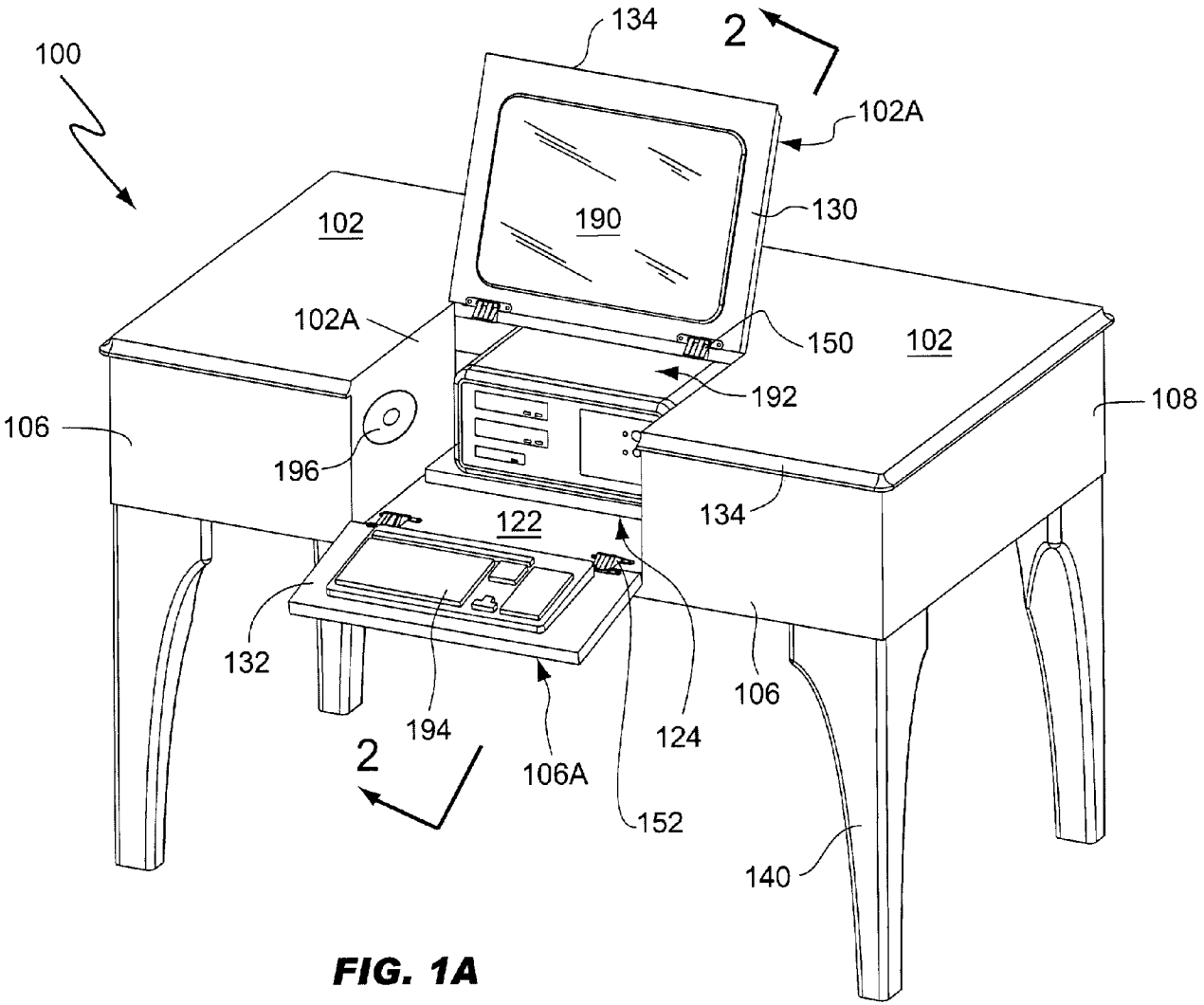
FIG. 1A is the recessed-computer furniture unit with the access panels open, according to the first preferred embodiment of the present invention.
Figure 1B:
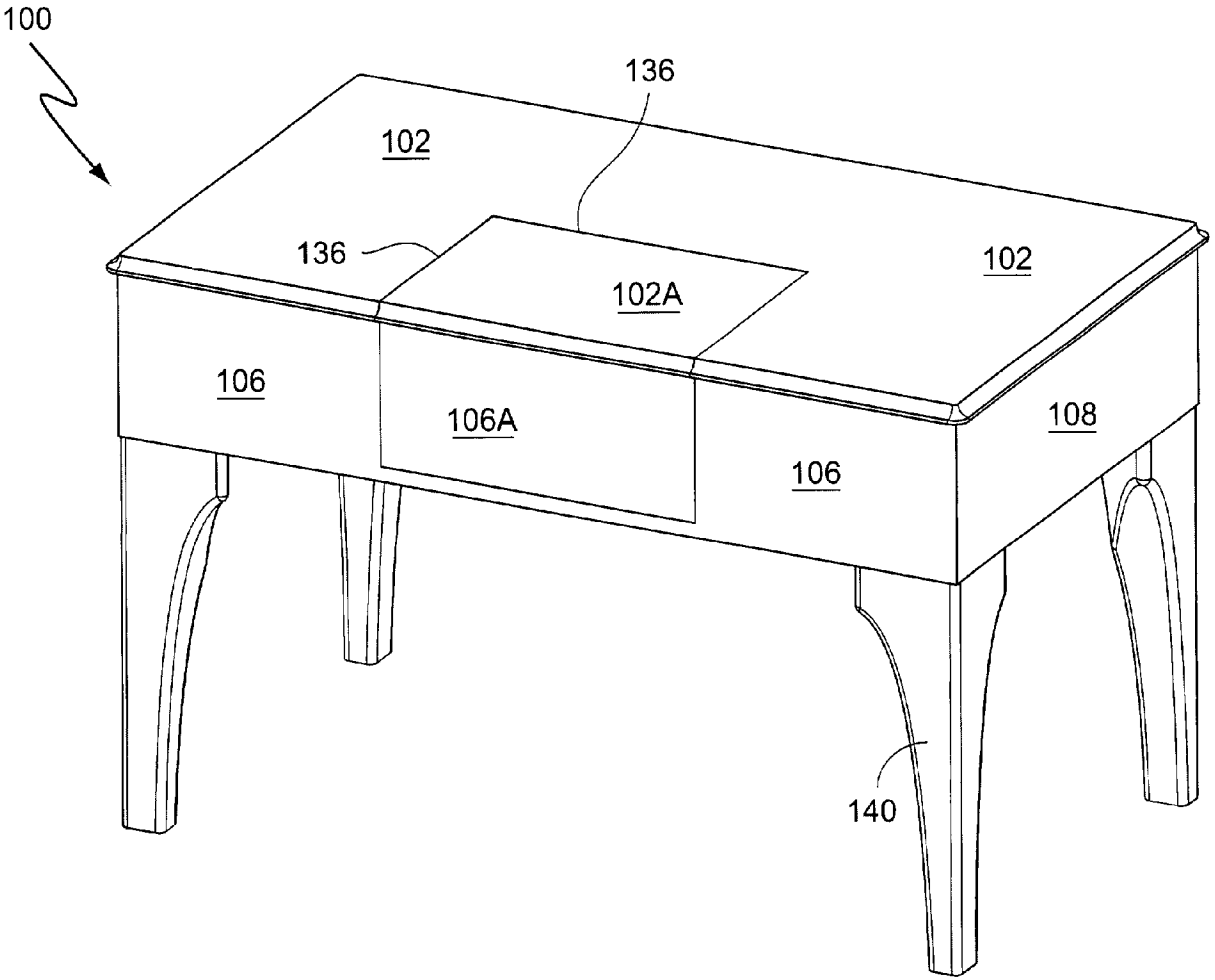
FIG. 1B is the recessed-computer furniture unit with the access panels closed, according to the first preferred embodiment of the present invention.

Referring to FIG. 1A, a recessed-computer furniture unit of the first preferred embodiment is illustrated. The first preferred embodiment generally includes various tables, including computer desks, computer tables, occasion tables, coffee tables, for retaining a general-purpose computer. As illustrated in FIG. 1B, the recessed-computer furniture unit (RCFU) 100 preferably includes one or more access panels which protectively conceal the computer in a closed configuration and provide ergonomic and visual access to the computer in an open or operable configuration.

As illustrated in FIG. 1A, the computer to which the first embodiment is adapted is preferably a personal computer including a computer housing 192 containing the central processing unit (CPU) and various cards, a key board 194, and a monitor 190. The computer housing 192 is preferably a desktop computer case generally configured to lie horizontally. Desktop computer cases have been traditional used in conjunction with a monitor, typically a cathode ray tube (CRT), that is placed on top of the desktop computer to minimize the footprint occupied by the computer. For purposes of the present invention, the computer housing 192 may also be a tower-type computer case designed to stand vertically or lie horizontally.

The monitor 190 in the preferred embodiment is generally referred to as a flat panel, i.e. a low profile monitor, which may be, for example, a liquid crystal display (LCD), a plasma screen, or touch screen. CRTs are generally unsuitable for the present invention due to their relatively burdensome size and weight requirements.

One skilled in the art will recognize that the recessed-computer furniture unit of the of the present invention is also suitably sized and configured for use with a flat panel television screen and a media player such as a DVD or VCR player; for media recorders such as TIVO®; and for interactive video game units such as Microsoft Xbox® video game system, Sony Playstation 2®, or Nintendo Gamecube™, for example.

The RCFU 100 of the preferred embodiment is generally comprised of a top side, a front side, a lower surface, and legs 140. The top side comprises a plurality of panels including the upper access panel 102A rotatably attached to the upper panel 102 by means of one or more hinges 150. The width and length of the upper access panel 102A, corresponding to and greater than the width and height of the monitor 190, respectively, are sized to receive the flat panel monitor 190 that attaches to the inner surface 130. Various devices known to those skilled in the art may be implemented to rigidly affix the monitor 190 to the upper access panel 102A include fasteners such as screws, bolts, and L-brackets that attach to the inner surface 130. In some embodiments, the monitor 190 may be inserted into a frame that traverses the upper and lower edged of the monitor, for example. To reduce the spatial requirements of the RCFU 100, the monitor 190 may be recessed into the upper access panel 102A.

Figure 2:
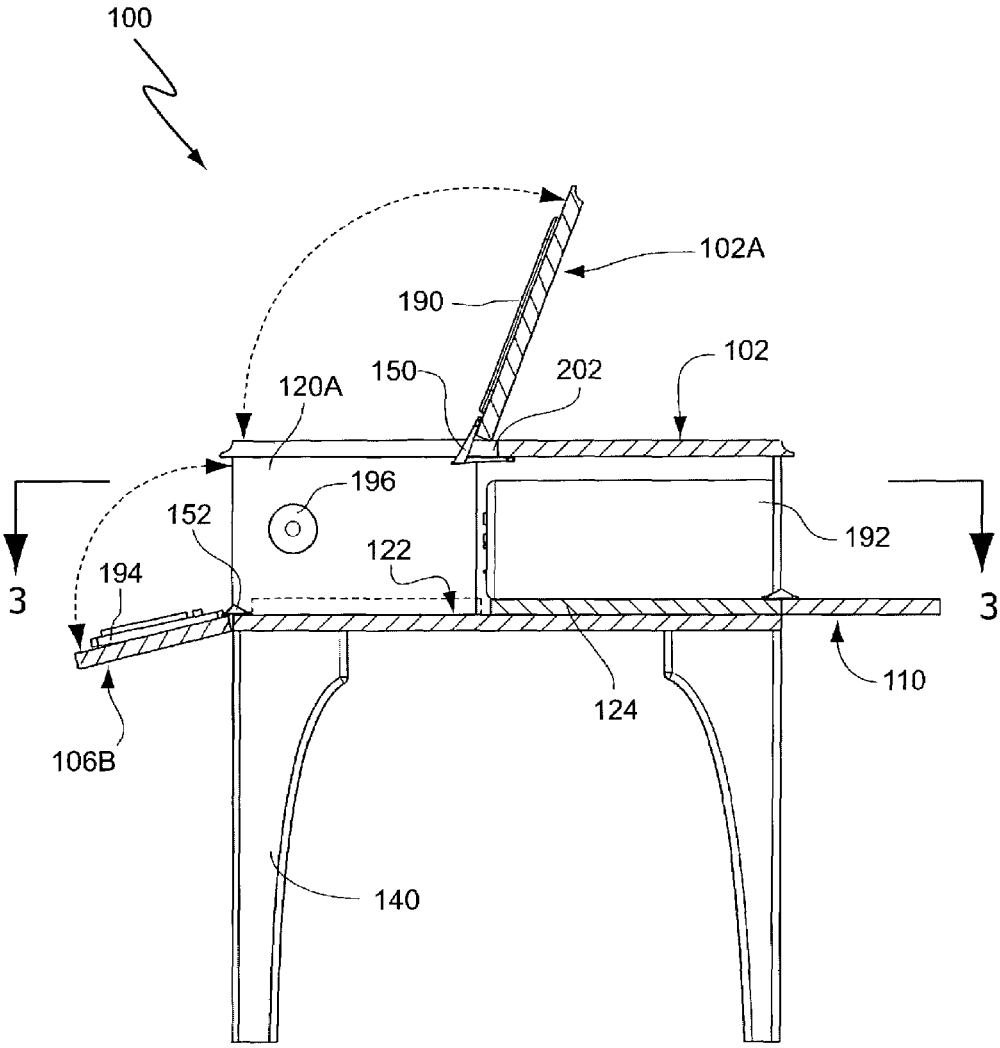
FIG. 2 is a vertical cross-section of the recessed-computer furniture unit, according to the first preferred embodiment of the present invention.

The one or more hinges 150 permit the upper access panel 102A to rotate between a generally vertical open position and a generally horizontal closed position. In the open position illustrated in FIG. 1A, the upper access panel 102A is seated into a substantially vertical orientation that permits the monitor 190 to be viewed and accessed by a user located at the front of the RCFU 100. As illustrated in FIG. 2, the upper access panel 102A in the preferred embodiment rotates between approximately 90 to 110 degrees where the panel 102A leans aft of the true vertical, thereby permitting the weight of the monitor 190 and upper access panel 102A to bias the combination in the upright position. In other embodiments, the RCFU 100 includes a hydraulic or pneumatic damping device to bias or locking device to releasably secure the upper access panel 102A in the upright position.

In the closed position illustrated in FIG. 1B, the upper access panel 102A lies substantially flush with the upper panel 102, thereby creating a substantially flat and substantially continuous surface for conducting work or structurally supporting various objects. In the preferred embodiment, the leading edge 134 of the RCFU 100 is generally uniform across the upper access panel 102A and upper panel 102, and the gap 136 is minimal to maintain the aesthetic appeal of the overall design and distract from the ulterior purpose (and interior computer) as much as is reasonably possible. One skilled in the art will recognizes that there are a number of suitable upper access panel 102A hinges 150 that may be inconspicuously mounted in or recessed below the gap 136 illustrated in FIG. 1B while providing the 90 to 110 degrees of rotation to prop up the monitor 190. Suitable hinges and hinge hardware includes, but is not limited to, the following: European hinges, concealed hinges, pin hinges, stay-closed door pivot hinges, piano hinges, concealed soss hinges, double-locking bi-fold door hinges, flush hinges, adjustable drafting table hardware, easy-lift lid supports, self-balancing lid support, soft-down supports, mortises supports for lids, and combined hinge and lid supports, The front side of the RCFU 100 comprises a plurality of panels including the front panel 106 and front access panel 106A. In the preferred embodiment, the front access panel 106A is rotatably attached to the RCFU 100 at or in proximity to the front panel 106, for example. The width of the upper access panel 102A is preferably sized to support the keyboard 194 which may be removably attached to the inner surface 132 or configured to slide out atop the inner surface 132 when the computer is in use.

The front access panel 106A is configured to rotate between a substantially horizontal closed position and a substantially vertical open position by means of front access panel 106A hinges 152. In the open position illustrated in FIG. 1A, the front access panel 106A projects out from the front surface 106 in a substantially horizontal or slightly inclined orientation in order to provide the computer user ergonomic access to the keyboard 194. In the closed position illustrated in FIG. 1B, the front access panel 106A retracts to a position substantially flush with upper access panel 102A, thereby preferably provide a uniform or otherwise continuous surface across a significant portion of the RCFU 100. A cross sectional view of the FIG. 1A taken at 2—2 is illustrated in FIG. 2.

Suitable front access panel 106A hinges 152 may be selected from the group of upper access panel 102A hinges 150 described above. One skilled in the art will appreciate, however, that the front access panel 106A hinges 152 need not be the same as the upper access panel 102A hinges 150.

For purposes of this invention, neither the top side or the front side need be planar. For example, either of the surfaces may possess various curvature, angularity, facets, recess, or ornamentation. It is important, however, that the upper access panel 102A and front access panel 106A be integrated with the adjacent surfaces of the RCFU 100 to maintain substantial surface continuity and thereby preserve the over all theme or style conveyed by the RCFU while drawing minimal attention to the re-configurable nature of the unit. As such, the wooden top side RCFU 100 of the preferred embodiment is constructed to preserve the grain, wood inlay, banding, or other decorative scheme in a continuous fashion across the upper panel and upper access panel, and across the front panel and front access panel. One skilled in the art will recognize that the RCFU 100 may also be constructed from a wide variety of materials including but not limited to wood, wood composites, various metals, and synthetic materials including plastic and fiber glass.

The RCFU 100 further includes a lower surface 122 that, in combination with upper access panel 102A and upper panel 102, creates a cavity or compartment adapted to receive the computer housing 192. The minimum profile of the RCFU 100 is therefore limited, in part, by the height requirements of the computer case that the RCFU 100 is designed to accommodate. In general, the height of contemporary desktop computer cases ranges between two inches and four inches, depending on the internal configuration of boards. In contrast, tower-type computer cases, when rotated 90 degrees, i.e. laid on their side, typically occupy as little as 6.5 inches, but rarely more than 9 inches, because of the standard width of various removable media drives, including CD-ROM and CD-R/W drives. One skilled in the art will recognize that allowances may be need to be made in determining the height between the lower surface 122 and the upper access panel 102A and upper panel 102 in situations in which the computer housing 192 is located immediately below the monitor 190 in the closed configuration.

In some embodiments, the RCFU 100 further includes side partitions, such as a left-side partition 120A and a right-side partition 120B illustrated in FIGS. 1A, 1B, 2, and 3. The side partitions server several purposes including, for example, structural support for the upper panel 102 which must bear the weight of the upper access panel 102A and the monitor 190. The side partitions increase the stiffness of the RCFU 100, thereby reducing the probability of vibration or impact being transferred to the monitor which could damage the monitor or dislodge the upper access panel 102A in the open configuration.

A side partition also provides a surface to which to mount various components including electronic devices or drawers, for example. One or both of the side partitions 120A, 120B may include, for example, one or more speakers mounted therein. The speakers 196 may be either fixed-direction speakers or variable-direction speakers. Moreover, the speakers may be mounted in proximity to the front side of the RCFU 100 or recessed in the cavity that retains the computer housing 192, thereby allowing the cavity to serve as an acoustic wave-guide with pleasing harmonic effect.

Figure 3:
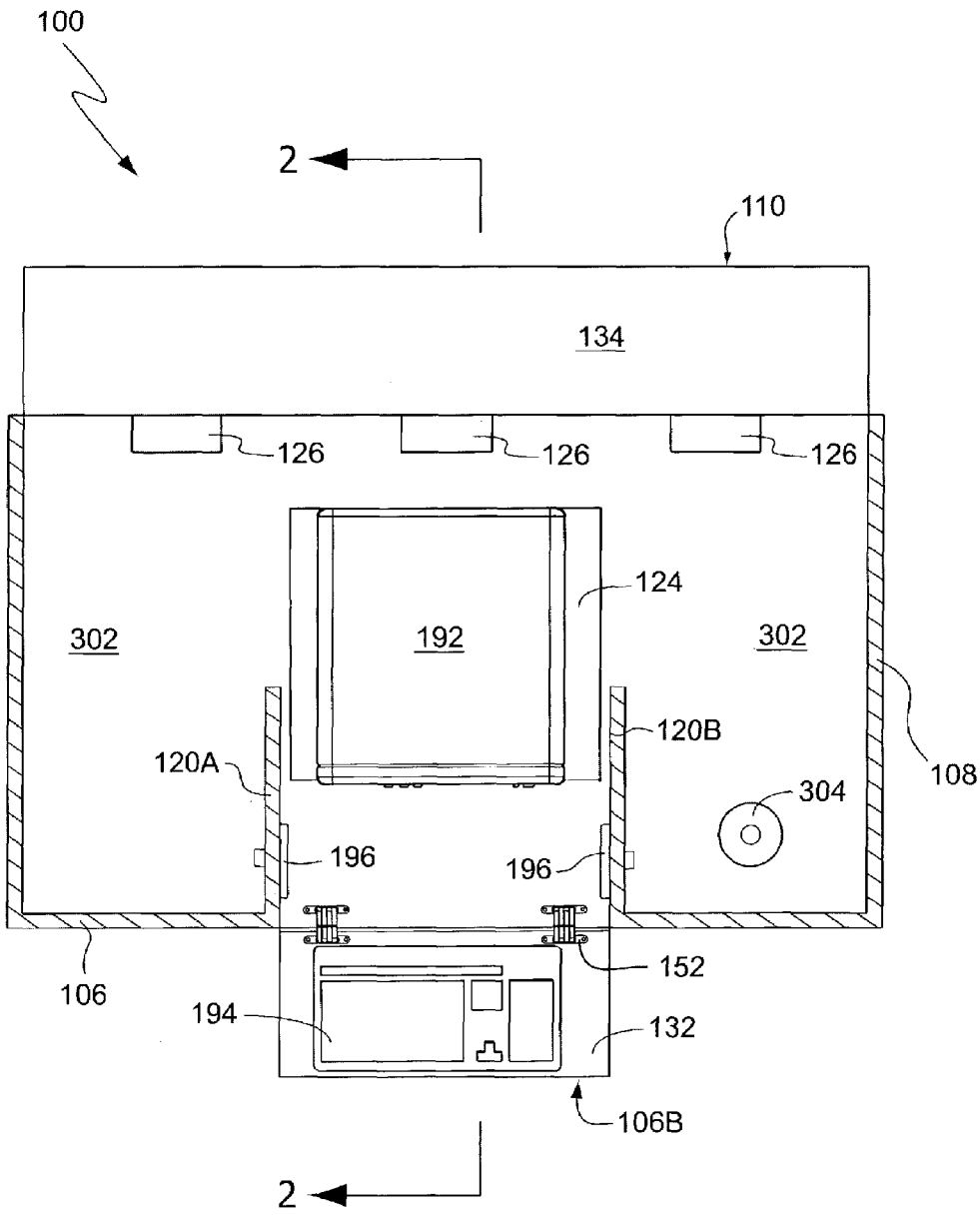
FIG. 3 is a horizontal cross-section of the recessed-computer furniture unit, according to the first preferred embodiment of the present invention.
Figure 4:
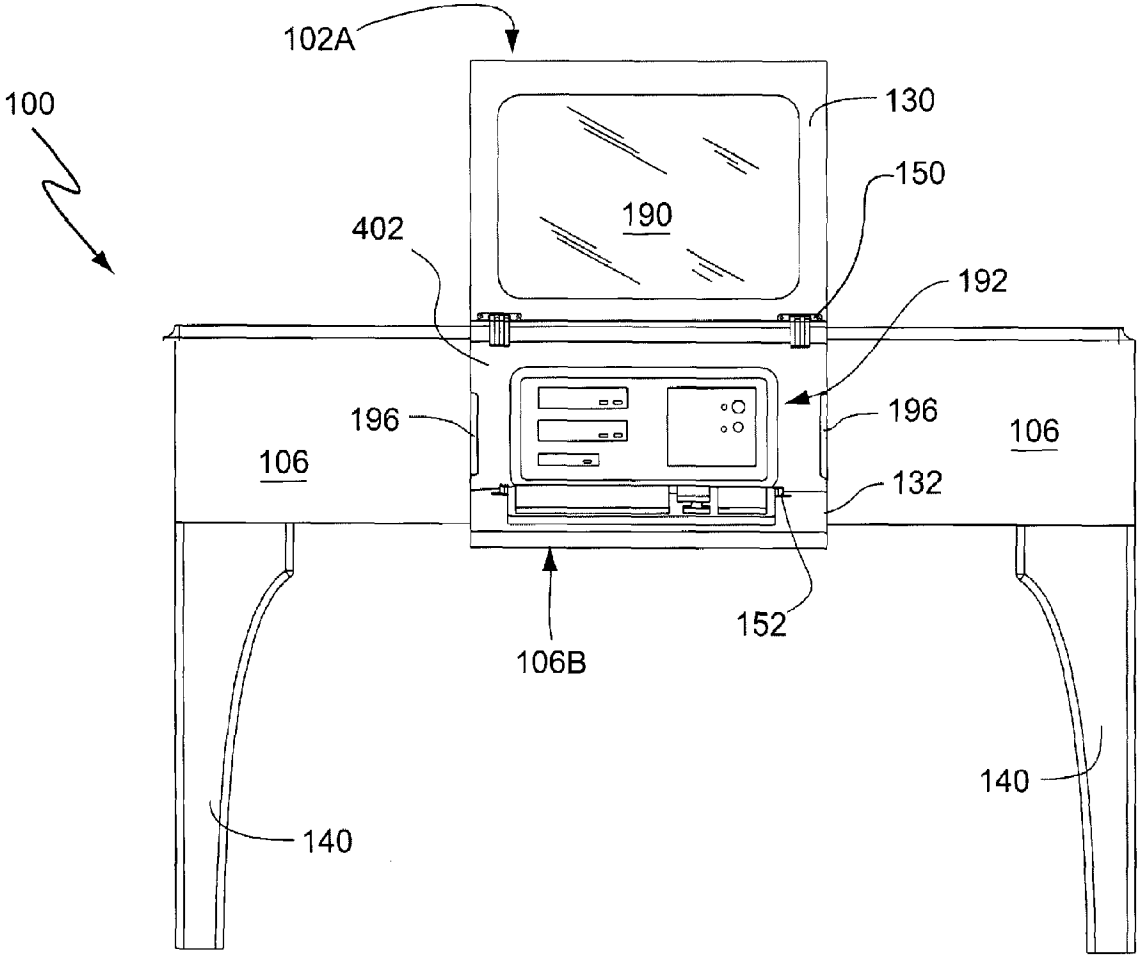
FIG. 4 is the recessed-computer furniture unit with the forward access panels open, according to the first preferred embodiment of the present invention.

A transverse view taken at 2—2 in FIG. 2 is illustrated in FIG. 3. One or more speakers may also be installed in a compartment 302 created between a side partition and the adjacent side 108 of the RCFU 100. In the preferred embodiment, a downwardly facing subwoofer 304 is installed in the lower surface 122, although one or more speakers may also be installed in this compartment 302 such the sound radiates within RCFU 100 and out the cavity 302 illustrated in FIG. 3. FIG. 4 illustrates a front view of this example embodiment of the present invention.

Figure 5:
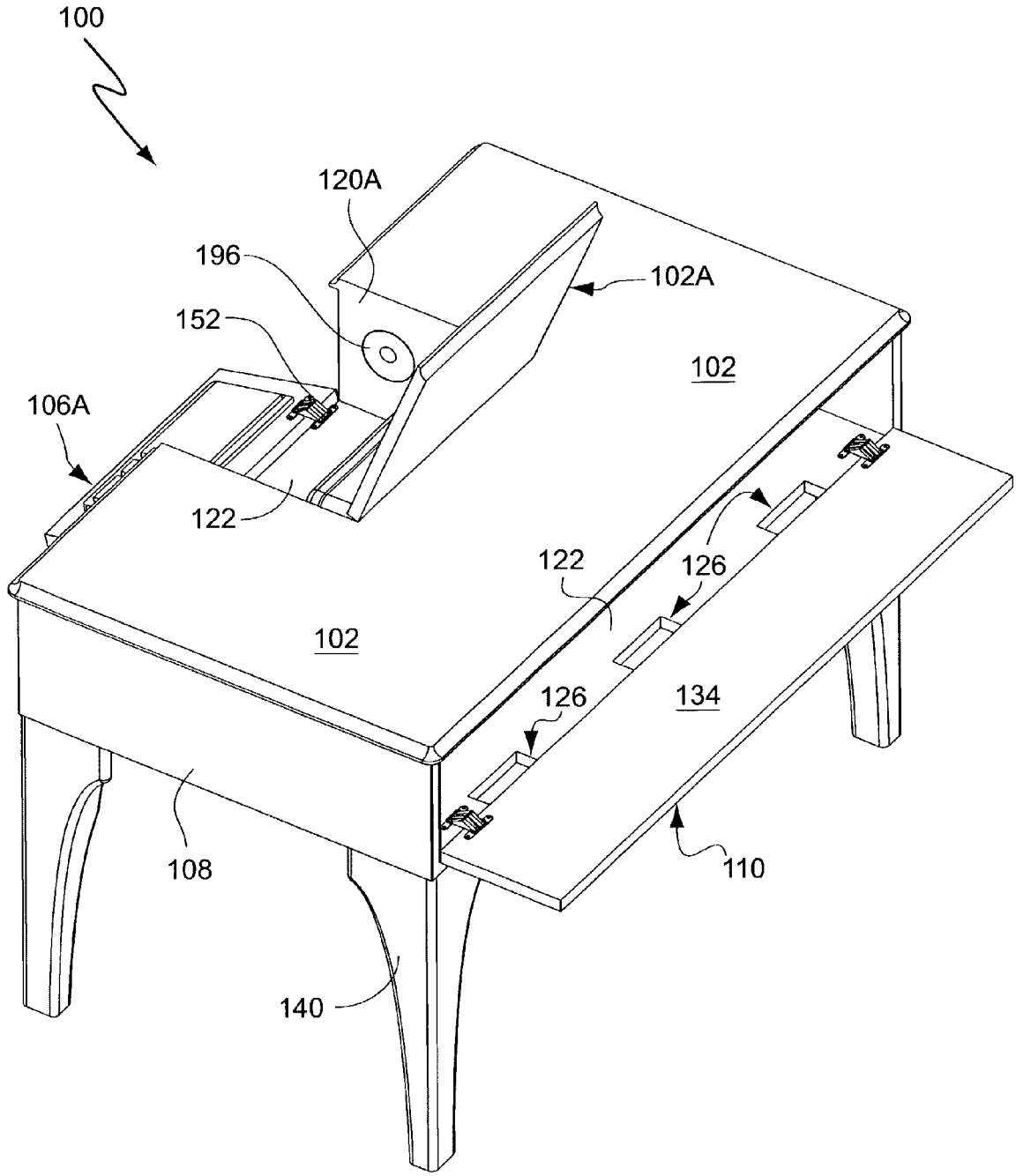
FIG. 5 is the recessed-computer furniture unit with the maintenance panel open, according to the first preferred embodiment of the present invention.

Referring to FIG. 5, the recessed-computer furniture unit with the maintenance panel open is illustrated. The maintenance panel 110 in this embodiment of the RCFU 100 protectively conceals the computer housing 192 while providing convenient access to the rear side of the housing 192 where most of the power and signal cabling are conventionally provided. In this embodiment, the maintenance panel 110 rotates downwardly, thereby extending the distance that the computer housing 192 may be pulled rearwardly. Also illustrated in FIG. 5 are cable channels 126, with or without grommets, providing openings through which power cables and networking cables, for example, may be run. Consistent surface continuity across the several embodiments of this invention have the exterior side of the maintenance panel preferably possessing a consistent pattern and/or texture as the balance of the RCFU 100 to preserve the continuity of surfaces of the RCFU and thereby disguise the presence of the computer concealed therein.

In some embodiments of the RCFU 100, including the occasion table embodiment, the distance between the front panel 106A and the maintenance panel 110 is substantial. To facilitate the movement of the computer housing 192 between the location in proximity to the user and the maintenance panel 110, some embodiments of the RCFU 100 include a computer case shuttle 124. The shuttle 124, as used herein, refers to a device adapted to convey the computer housing 192 forwards and backwards without scuffing or otherwise damaging the lower surface 122 or the computer housing itself. The shuttle 124 is a platform made to move by means of runners or rails mounted to the lower surface 122 or the left and right side partitions 120A and 120B, for example. The extreme forward and rear positions of the shuttle 124 are clearly illustrated in FIG. 3.

In other embodiments, the lower surface includes a protective liner selected to resist scuffing or other damage to the RCFU 100 or computer housing 192 that may result from moving the computer housing in and out of the cavity 402.

Figure 6:
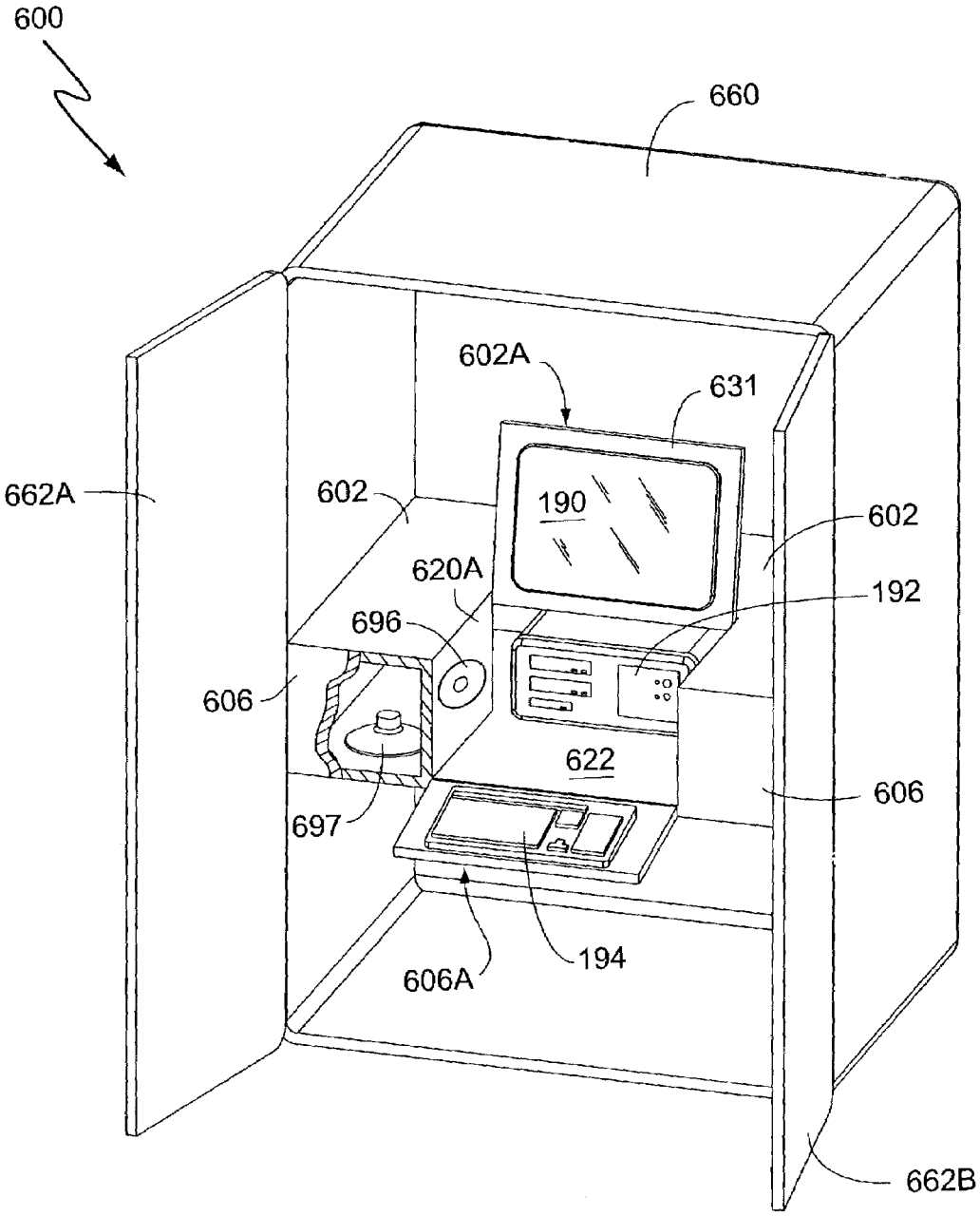
FIG. 6 is the recessed-computer furniture unit, according to the second preferred embodiment of the present invention.

Referring to FIG. 6, the second preferred embodiment of the recessed-computer furniture unit is illustrated. The RCFU in this embodiment is integrated into an armoire 600 into which the computer is concealed until it is configured for use. The armoire 600 generally comprises a cabinet 660, doors 662A–B, and the RCFU. The RCFU inside the cabinet 660 comprises a top side, front side, and lower surface. The top side comprises an upper panel 602 and an upper access panel 602A. As described in the first embodiment, the upper access panel 602A rotates between a lower position substantially flush with the upper panel 602, and the raised position that orients the attached monitor 190 towards the user.

The front side comprises a front panel 606 and a front access panel 606A that rotates between a closed position substantially flush with the front panel 606, and an open position in which the front access panel 606A extends to provide access to and support for the keyboard 194.

The lower surface 622, in combination with the upper access panel 602A and upper panel 602 create a cavity adapted to receive the computer housing 192. As described above, the RCFU unit may further include a left side partition 620A and/or a right side partition (not shown), either of which may include one or more speakers 696. The one or more speakers 696, when preferably augmented by a subwoofer 697 mounted in the lower surface 622, provide by the nature of the resulting housing an excellent acoustic experience.

Figure 7:
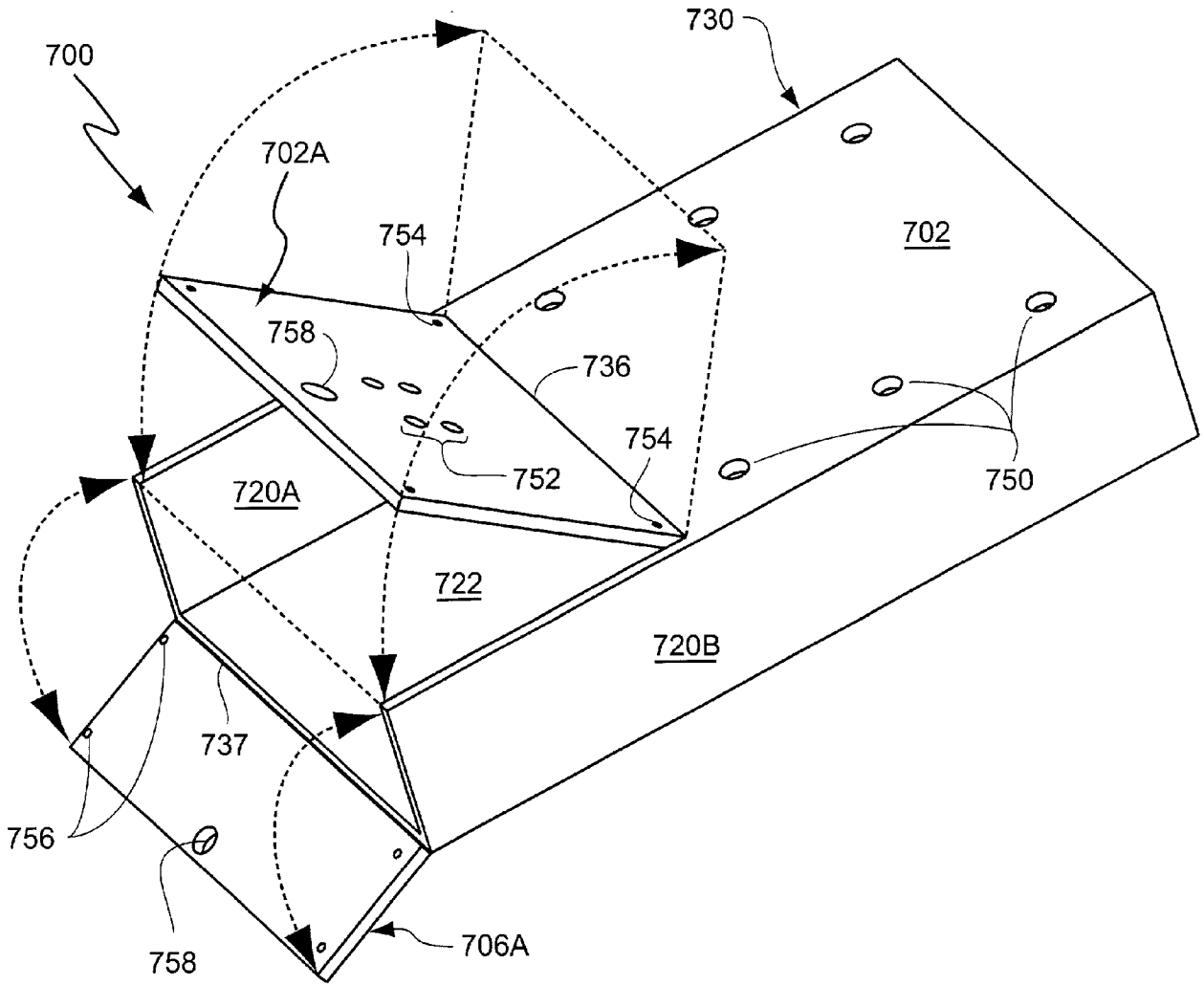
FIG. 7 is the modular recessed-computer furniture unit, according to the third preferred embodiment of the present invention.

Referring to FIG. 7, the third preferred embodiment of the recessed-computer furniture unit is illustrated. The RCFU 700 is embodied in an integrated module that can be prefabricated and incorporated into any number of pieces of home or office furniture to provide the functionality of the prior embodiments. In its most basic form, the modular RCFU 700 comprises an enclosure or frame 730 to which the upper access panel 702A and front access panel 706A rotatably attach. The frame 730 is, in turn, adapted to attach to the furniture itself. In the preferred embodiment, the modular RCFU 700 is fabricated from sheet metal although one skilled in the art will recognize that numerous alternative configurations may be implemented using framing elements such as brackets, and fasteners such as metal straps, rods, tubing, bolts, and or threaded couplings, for example.

The frame 730 in the preferred embodiment includes an upper member 702, a lower member 722, and side members 720A and 720B, which are analogous to the upper panel 102, lower panel 122, and side partitions 120A and 120B, respectively. The cavity created between the upper member 702 and the lower member 722 is sized to receive a computer housing. The frame is preferably equipped with pre-drilled holes 750 for mounting the frame to the underside of a desk top or counter top used in various furniture including modular office furniture.

The monitor 190 then attaches to the bolt holes 752 of the front access panel 702A that mate with the corresponding threads present in the backside of many flat panel monitors. As described in previous embodiments, the front access panel 702 is rotatably attached by means of hinges (not shown) affixed at the line 736 where the upper access panel 702A and upper member 702 converge. In some embodiments, the upper access panel 702A further includes mounting holes 754 used to rigidly affix a section of desk top or counter top (not shown) that covers the upper access panel 702A and, preferably, matches the surface pattern and/or texture of the corresponding section of desk top or counter top (not shown) to which the upper member 702 attaches.

The keyboard either rests upon or attaches to the front access panel 706A, which is rotatably attached to the lower member 722 by means of one or more hinges (not shown) affixed at the edge 737 where the front access panel 706 and front member 706A converge. In some embodiments, the front access panel 706A further includes mounting holes 756 used to rigidly affix a section of facade (not shown), for example, that covers the front access panel 702A and, preferably, matches a corresponding section that flank the modular RCFU 700 on either side.

In some embodiments, the upper access panel 702A and or front access panel 706A further include a lock or lock hole 758 used to securably conceal the computer housing 192 or other valuables contained therein.

Although the description above contains many specifications, these should not be construed as limiting the scope of the invention but as merely providing illustrations of some of the presently preferred embodiments of this invention.

Therefore, the invention has been disclosed by way of example and not limitation, and reference should be made to the following claims to determine the scope of the present invention.

I claim:

1. A recess-computer furniture unit, for housing a general-purpose computer, wherein the Computer comprises a computer housing, a flat panel monitor, and a computer keyboard; the recess-computer furniture unit comprising:

(a) a topside comprising;

(i) an upper panel;

(ii) an upper access panel adapted to securably support the flat panel monitor; wherein the upper access panel rotates relative to the upper panel from a closed position substantially flush with the upper panel to at least a substantially vertical position in which the flat panel monitor mounted thereon is visible to a user; and (iii) one or more fasteners adapted to detachably attach the flat panel monitor to the upper access panel; and (b) a front side comprising:

(i) a front panel;and (ii) a front access panel unit adapted to securably support the computer keyboard; wherein the front access panel rotates between a closed position substantially flush with the front panel, and a substantially horizontal position in which the keyboard is ergonomically accessible;

(c) a lower surface displaced from the top side so as to form a cavity adapted to receive the computer housing; and (d) side partitions, including a left-side partition and a right-side partition defining the sides of the cavity that receives the computer housing, wherein one or more speakers arc mounted in the side partitions;

wherein the computer housing, flat panel monitor, and computer keyboard are protectively concealed within the recess-computer furniture unit when the upper access panel and front access panel are seated in a closed position.

2. A recess-computer furniture unit, for housing a general-purpose computer, wherein the computer comprises a computer housing a flat panel monitor, and a computer keyboard; the recess-computer furniture unit comprising:

(a) a top side comprising:

(i) an upper panel;

(ii) an upper access panel adapted to securably support the flat panel monitor; wherein the upper access panel rotates relative to the upper panel from a closed position substantially flush with the upper panel to at least a substantially vertical position in which the flat panel monitor mounted thereon is visible to a user, and (iii) one or more fasteners adapted to detachably attach the flat panel monitor to the upper access panel;

(b) a front side comprising:

(i) a front panel; and (ii) a front access panel unit adapted to securably support the computer keyboard; wherein the front access panel rotates between a closed position substantially flush with the front panel, and a substantially horizontal position in which the keyboard is ergonomically accessible;

(c) a lower surface displaced from the top side so as to form a cavity adapted to receive the computer housing;

(d) a maintenance panel, whereby a user may access a computer housing protectively concealed in the cavity; and, (e) a protective liner in proximity to the lower surface for minimizing damage to the recess-computer furniture unit or the computer housing when moving the computer housing between a first position in proximity to the front access panel and a second position in proximity to the maintenance panel;

wherein the computer housing, flat panel monitor, and computer keyboard are protectively concealed within the recess-computer furniture unit when the upper access panel and front access panel are seated in a closed position.

3. A recess-computer furniture unit, for housing a general-purpose computer, wherein the computer comprises a computer housing, a flat panel monitor, and a computer keyboard; the recess-computer furniture unit comprising:

(a) a top side comprising:

(i) an upper panel;

(ii) an upper access panel adapted to securably support the flat panel monitor, wherein the upper access panel rotates relative to the upper panel from a closed position substantially flush with the upper panel to at least a substantially vertical position in which the flat panel monitor mounted thereon is visible to a user; and (iii) one or more fasteners adapted to detachably attach the flat panel monitor to the upper access panel;

(b) a front side comprising:

(i) a front panel; and (ii) a front access panel unit adapted to securably support the computer keyboard; wherein the front access panel rotates between a closed position substantially flush with the front panel, and a substantially horizontal position in which the keyboard is ergonomically accessible;

(c) a lower surface displaced from the top side so as to form a cavity adapted to receive the computer housing;

(d) a maintenance panel, whereby a user may access a computer housing protectively concealed in the cavity; and, (e) a shuttle slidably attached to the recess-computer furniture unit for moving the computer housing between a first position in proximity to the front access panel and a second position in proximity to the maintenance panel;

wherein the computer housing, flat panel monitor, and computer keyboard are protectively concealed within the recess-computer furniture unit when the upper access panel and front access panel are seated in a closed position.

4. A recess-computer furniture unit, for housing a general-purpose computer, the computer comprising a computer housing, a flat panel monitor, and a computer keyboard; the recess-computer furniture unit comprising:

(a) a top side comprising:

(i) an upper panel;

an upper access panel adapted to securably support the flat panel monitor; wherein the upper access panel rotates relative to the upper panel from a closed position substantially flush with the upper panel to at least a substantially vertical position in which the flat panel monitor mounted thereon is visible to a user; and (iii) one or more fasteners adapted to detachably attach the flat panel monitor to the upper access panel;

(b) a lower surface displaced from the top side so as to form a cavity adapted to receive the computer housing; and, (c) at least one side partition having one or more speakers, the at least one side partition being affixed to the upper panel and lower surface, thereby forming at least one surface boundary for cavity adapted to receive the computer housing;

wherein the flat panel monitor is mounted to and protectively concealed by the upper access panel and the recessed-computer furniture unit when the upper access panel is seated in a closed position.

5. A recess-computer furniture unit, for housing a general-purpose computer, the computer comprising a computer housing, a flat panel monitor, and a computer keyboard; the recess-computer furniture unit comprising:

(a) a top side comprising:

(i) an upper panel;

(ii) an upper access panel adapted to securably support the flat panel monitor; wherein the upper access panel rotates relative to the upper panel from a closed position substantially flush with the upper panel to at least a substantially vertical position in which the flat panel monitor mounted thereon is visible to a user; and (iii) one or more fasteners adapted to detachably attach the flat panel monitor to the upper access panel;

(b) a maintenance panel, whereby a user may access a computer housing protectively concealed in the cavity;

(c) a lower surface displaced from the top side so as to form a cavity adapted to receive the computer housing; and, (d) a protective liner in proximity to the lower surface for minimizing damage to the recess-computer furniture unit or the computer housing when moving the computer housing between a first position in proximity to the front access panel and a second position in proximity to the maintenance panel;

wherein the flat panel monitor is mounted to and protectively concealed by the upper access panel and the recessed-computer furniture unit when the upper access panel is seated in a closed position.

6. A recess-computer furniture unit, for housing a general-purpose computer, the computer comprising a computer housing, a flat panel monitor, and a computer keyboard; the recess-computer furniture unit comprising;

(a) a top side comprising:

(i) an upper panel;

(ii) an upper access panel adapted to securably support the flat panel monitor; wherein the upper access panel rotates relative to the upper panel front a closed position substantially flush with the upper panel to at least a substantially vertical position in which the flat panel monitor mounted thereon is visible to a user; and (iii) one or more fasteners adapted to detachably attach the flat panel monitor to the upper access panel;

(b) a maintenance panel, whereby a user may access a computer housing protectively concealed in the cavity; and (c) a shuttle slidably attached to the recess-computer furniture unit for moving the computer housing between a first position in proximity to the front access panel and a second position in proximity to the maintenance panel; wherein the flat panel monitor is mounted to and protectively concealed by the upper access panel and the recessed-computer furniture unit when the upper access panel is seated in a closed position.

* * * * *